US008327914B2

(12) United States Patent
Zheng et al.

(10) Patent No.: US 8,327,914 B2
(45) Date of Patent: Dec. 11, 2012

(54) FEEDING SYSTEM FOR SEMI-SOLID METAL INJECTION

(75) Inventors: Chang-Qing Zheng, Chicoutimi (CA); Florentin Laplume, Chicoutimi (CA)

(73) Assignee: National Research Council of Canada, Ottawa, ON ( * ) Notice: Subject to any disclaimer, the term of this patent is extended or adjusted under 35 U.S.C. 154(b) by 10 days.

(21) Appl. No.: 12/786,936

(22) Filed: May 25, 2010

(65) Prior Publication Data

US 2011/0108231 A1 May 12, 2011

Related U.S. Application Data

(60) Provisional application No. 61/272,822, filed on Nov. 6, 2009.

(51) Int. Cl.
*B22D 17/04* (2006.01)
*B22D 23/00* (2006.01)

(52) U.S. Cl. ..... 164/312; 164/113; 164/457; 164/900

(58) Field of Classification Search ..... 164/113, 164/312, 900, 457
See application file for complete search history.

(56) References Cited

U.S. PATENT DOCUMENTS

| | | | | |
|---|---|---|---|---|
| 5,730,201 | A * | 3/1998 | Rollin et al. | 164/113 |
| 6,382,302 | B1 * | 5/2002 | Imwinkelried | 164/312 |
| 7,299,854 | B2 * | 11/2007 | Kamm et al. | 164/113 |
| 7,341,094 | B2 * | 3/2008 | Manda | 164/312 |
| 8,047,258 | B1 * | 11/2011 | Zeimet et al. | 164/4.1 |

FOREIGN PATENT DOCUMENTS

| | | | |
|---|---|---|---|
| EP | 940206 | A1 * | 9/1999 |
| JP | 2003251447 | | 9/2003 |

* cited by examiner

*Primary Examiner* — Jessica L Ward
(74) *Attorney, Agent, or Firm* — Jason E. J. Davis

(57) ABSTRACT

A semi-solid metal alloy injection feed system for reduced inclusion injection molding comprises a substantially closed injection chamber for containing a billet of semi-solid metal alloy, and thrusting the billet through the injection chamber into a mold, wherein the injection chamber has a first section defined by a wall with an inner contour for mating with a bearing surface for reciprocating motion of the bearing surface within the first section, along a center axis of the injection chamber; and the injection chamber has an outlet in fluid communication with the mold, the outlet provided at an opening in the injection chamber that is offset with respect to the center axis, and is disposed at an angle of 90° to 125° from the center axis. There is no neck or throttling between the chamber and the outlet. A butt end trap is preferably formed that requires inclusions that are principally on a bottom side of the injector to travel a relatively long ways to enter the outlet.

18 Claims, 5 Drawing Sheets

FEEDING SYSTEM FOR SEMI-SOLID METAL INJECTION

FIELD OF THE INVENTION

The present invention relates in general to die casting moulds, and, in particular, to a mould for die casting semi-solid metal and like materials that require lubricated injection, that decreases lubricant contamination and waste, and simplifies demoulding by placing the exit port to the mould directly on a piston chamber at a decentralized position that is oriented substantially opposite where lubricant pools.

BACKGROUND OF THE INVENTION

Pressure injection of semi-solid metal alloy (a finely divided solid metal phase blended in a molten metal phase) into a mould is of growing importance because of the strength and reproducibility of parts that can be achieved. In the semi-solid state material can be forced through small apertures at high rates, as a relatively low shear resistance is exhibited. As a result the technique yields near net shape production of complex, detailed shapes (even with thin walls) and advantageously provides high part consistency, and high production rates, with lower temperature dies.

This technique is relatively new and there is a limited understanding of the semi-solid process. While mould geometry and feed system designs were generally adapted from conventional die-casting nozzles, there are significant differences between the rheological properties of semi-solid metal alloys and the molten metals used in conventional die casting. Generally the temperatures are lower, and the flow properties are different.

In general, known horizontal injectors (as shown in FIG. 1) include pistons with chambers of constant cross-section to accommodate the pistons in reciprocating motion. An outlet of the chamber is generally concentric with the piston and is provided on an end face of the chamber where the semi-solid metal alloy is throttled to couple with one or more casting chambers or moulds. The concentric, throttled outlet encourages higher flow rates through the outlet and into the one or more mould cavities. Typically these injector outlets have undercut openings between a neck portion that communicates directly with the chamber, and the opening to one or more moulds. An example of such a horizontal injector is the model taught in JP2003251447 to Toshiyuki of Honda Motor Co. Ltd.

An improvement on this type of injector is taught in U.S. Pat. No. 7,341,094 to Manda (FIG. 3 thereof), which includes a piston chamber 14 that narrows abruptly to a neck portion (surrounded by heater element 42) to a final port which is produced in a 2 piece mould cavity. This design avoids an external chamber intermediate the injector cavity and the mould cavity, at the expense of limiting a shape of the moulds that can be injected (as they need to include space at the opening to hold the tip of the injector), and result in the imprinting of this tip on the surface of the moulded part, as well as irregular ears produced between the tip and the mould, that would typically have to be removed by post cast machining. It is noted that in the configurations shown in FIGS. 1,2,7 and 8, there is a single port.

Casting defects are a problem with high end applications of this method, generally in the form of inclusions (such as oxides or lubricants), porosities, surface blisters, etc. Some defects are related to outside layer drag, which is caused by a skin formed on the semi-solid metal alloy billet while it is dispensed into the injector, while it dwells in the injector and as the injector is actuated. The skin may be solidified to a higher degree than the rest of the semi-solid metal alloy billet, have different composition and may contain more lubricant, or oxides, especially at a bottom surface where the lubricant tends to pool. It is very difficult to avoid these problems as the material cools very rapidly on contact with the chamber. The skin has an important impact on the flow properties of the semi-solid metal alloy billet potentially leading to a folding, buckling or fracture of the skin which may introduce voids or space that is filled with lubricant, for example. While the semi-solid metal alloy is in motion, the outside skin can penetrate the middle layer and become trapped in the parts. In some applications this is tolerated, but in high-end production, it is desirable to avoid the inclusion of the skin.

Injection processes often use lubricants to ease sliding of the feedstock and/or a piston or bearing surface that forces the material out of the injector. When heated, lubricant may decompose or create oval or half-moon porosities in the finished products. As heat treatment is often used to increase mechanical properties of semi-solid metal alloy castings, the inclusion of lubricant can lead to lenticular porosities.

Furthermore the ejection of parts from moulds using this outlet structure may increase an amount of wasted semi-solid metal alloy, and require several moving parts such as slides (rails) and drawers. These can increase a complexity of the mould and makes them prone to mechanical breakdown, and may lead to more seams into which semi-solid metal alloy can infiltrate, leaving seams that may need to be removed by post cast processing.

The known outlet structure also extends a path between the chamber and the mould. This is undesirable because the path is relatively narrow and therefore exhibits a higher surface area to volume ratio which leads to a faster cooling rate and general heating losses, as well as pressure losses during filling and intensification stages of the die casting process.

One solution to the problem of lubricant and skin contamination used by many thixo mould manufacturers, including ALU Suisse is to remove the skin by adding an annular skimming trough (i.e. ring tank of FIG. 1) that encircles the injection chamber, surrounding the outlet. Applicant has experimented with home-made design incorporating the ring tank, in a manner very similar to that taught in U.S. Pat. No. 5,730,201 to Reollin Erich et al, from AluSuisse, which is currently in practice throughout the thixo semi-solid die casting community. Applicant has found that this it does not work satisfactorily. Applicant has concluded that a build-up of material in a dead zone between the ring tank and the outlet forms a sliding slope that encourages the skin to slide into the outlet, and finds highly turbulent flow of the material past the throttling entry channel.

It is noted that no annular skimming trough or other trap is taught, shown or suggested by U.S. Pat. No. 7,341,094 to Manda, and further that any skin formed in the chamber would invariably be mixed with the bulk of the semi-solid metal alloy in the rapid transition from the chamber to the neck, and would thus be inextricable from the remainder of the billet at the outlet. Such systems do not manage inclusions in the feed supply, and incorporate a sharp turn in the neck section.

Accordingly there is a need for an injector for semi-solid metal alloy casting that more effectively reduces the inclusion of the skin, especially a skin on a portion of the chamber where cooling is faster and lubricant is expected to pool. Additionally it is desirable to reduce a length of a channel between the piston chamber and the mould cavity, to reduce thermal and pressure losses, and simplify demoulding.

SUMMARY OF THE INVENTION

Applicant has discovered, unexpectedly, that placement of the outlet on the wall of the piston chamber does not appreciably detract from the flow characteristics of the ejector, as would be expected if, for example, molten metal were ejected. The apparatus is particularly suited to high quality semisolid moulding and casting, where oxides, lubricants, and impurities are avoided.

The concentric outlet that is prevalent in the prior art feed system, increased a length of relatively low cross-section flow between the piston chamber and mould cavity. The present invention avoids this. The flow is also streamlined. The throttling neck and sharp angle bend in the prior art that induce turbulence, and encourage stirring of the semi-solid metal alloy and entrainment of skin, are avoided. Furthermore, by placing the outlet opposite from the part of the chamber where lubricant is expected to pool, a horizontal injector can be provided that naturally produces a butt end trap for the skin and lubricant. Such a butt end trap is advantageous because of the distance the lubricant needs to travel before it could enter the outlet.

To efficiently communicate the force from the ejector through the outlet and into the mould, and to encourage more laminar flow, the outlet on the wall of the piston chamber is preferably disposed at an angle such that the flow of the semi-solid metal alloy is deflected by an angle of 55° to 90° with respect to the direction of thrust of the piston. The channel communicating the flow between the piston chamber and mould can be chosen to be substantially straight, avoiding further changes in direction that might otherwise result in turbulent flow, or increase billet deformation during filling. No throttling of the flow other than at an outlet of the chamber and no bend other than the bend between the channel and chamber are effected by the system. The channel is preferably slightly convergent, and may include a scraper and secondary trap for skin and/or lubricant.

Accordingly, a semi-solid metal alloy injection feed system is provided that comprises: a substantially closed injection chamber for supporting flow of a billet of semi-solid metal alloy, the injection chamber having a piston mating section for receiving a piston in reciprocating motion; and a channel for communicating flow of the billet from an outlet of the injection chamber into a mould opening; wherein the outlet is offset with respect to a center axis of the piston mating section, so that the center axis does not intersect the outlet, the outlet being the first substantial narrowing of the flow through the injection chamber.

The channel preferably has an axis that makes an angle of 90-125° with respect to the center axis, and the outlet preferably has a cross-sectional area of 30-50% that of the piston mating section. The outlet may be offset from the center axis by at least 60% or more preferably 85% of the distance from the center axis to the periphery of the piston chamber.

The injection chamber may include a wall that extends continuously from the piston receiving section and into an ejection section, and the outlet is on the wall within the ejection section. If so a space between the ejection section and an end of the injection chamber may provide a butt end trap. The butt end trap may narrow from the ejection section to the end. The butt end trap may be a 5 to 30 mm distance between the ejection section and the end of the injection chamber.

The channel may be shorter than a diameter of the piston mating section, and may be shorter than 100 mm. The channel may have an axis that makes an angle of 90-125° with respect to the center axis, and this may be the only substantial redirection of the flow within the injection feed system. The channel may gradually narrow from the outlet to the mould opening, e.g. the cross-section of the mould opening may be 20-100% that of the outlet. In a plane of injection (including the center axis and channel axis) the channel may narrow by an angle of 0° to 20°.

The channel may include a secondary tank that strips a surface of the flow. The channel may narrow gradually from the outlet to the mould opening except in the vicinity of the secondary tank. The secondary tank may have a volume of 1-15% by volume of the flow. The secondary tank may remove 0.5-5 mm of the surface of the flow on one or more sides of the flow.

The injection feed system may be designed for horizontal use. If so the opening is preferably positioned above an expected lubricant pooling region; or more preferably substantially opposite the expected lubricant pooling region.

The injection feed system may be composed of two parts: one part including the piston mating section, part of the ejection section, and part of the channel, and the other part including the butt end trap, and the other part of the ejection section and channel, whereby separation of these two parts alone permit removal of the part remaining in the injection feed system after use.

Further features of the invention will be described or will become apparent in the course of the following detailed description.

BRIEF DESCRIPTION OF THE DRAWINGS

In order that the invention may be more clearly understood, embodiments thereof will now be described in detail by way of example, with reference to the accompanying drawings, in which.

DESCRIPTION OF PREFERRED EMBODIMENTS

Figure 1:
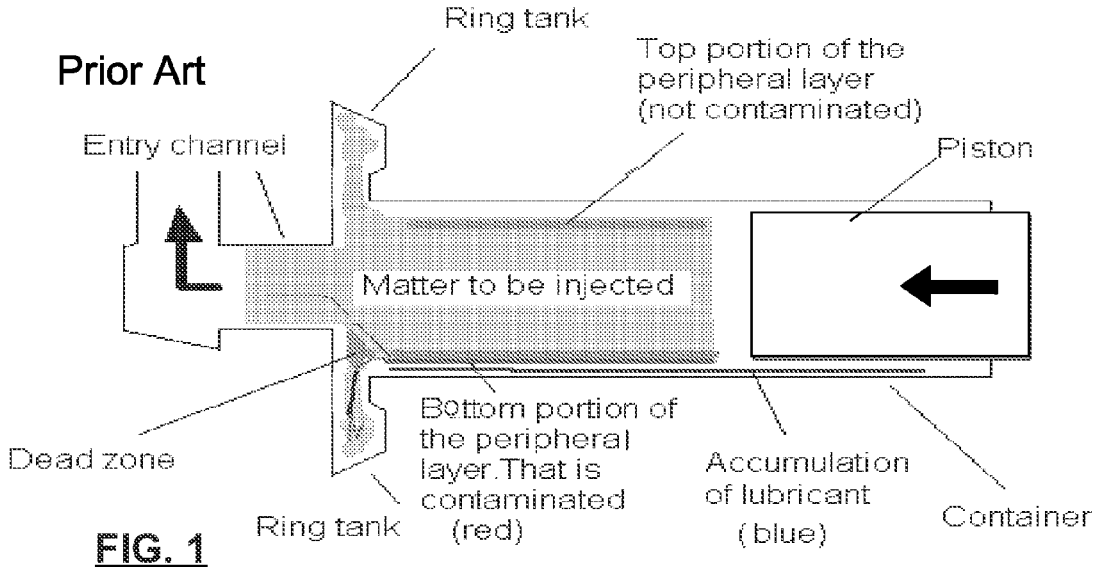
FIG. 1 is a schematic illustration of a prior art semi-solid injection feed system having a rink tank, and a throttled concentric exit to the piston chamber.
Figure 2A:
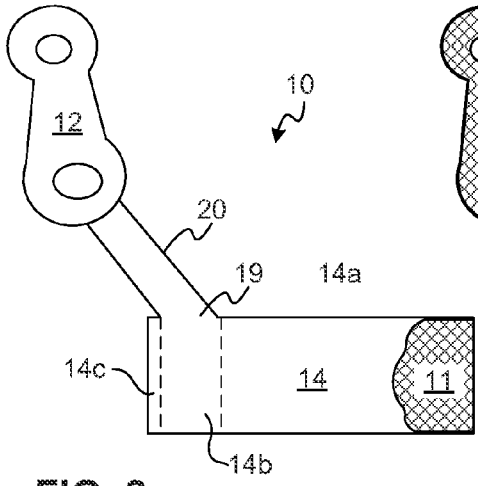
FIGS. 2*a,b* are a schematic illustrations of a semi-solid metal alloy injection feed system and mould in accordance with an embodiment of the invention, having a billet loaded and ready for injection, and after injection, respectively.

FIGS. 2*a,b* are schematic illustrations of a semi-solid metal alloy injection feed system 10 in accordance with an embodiment of the invention in two states of activation. In FIG. 2*a* the injection feed system 10 is loaded with semi-solid metal alloy billet 11 (partially in view), and coupled to a mould 12, ready for injection. In FIG. 1*b*, the injection feed system 10 has injected the semi-solid metal alloy, and the mould 12 is filled.

The injection feed system 10 defines a piston chamber 14 having 3 sections: a piston mating section 14*a*, an ejection section 14*b*, and a butt end trap 14*c*. The piston mating section 14*a* is characterized by a regular inner contour for mating with a piston 18 or like bearing surface. The wall of the piston chamber 14 is essentially continuous throughout the piston mating section 14*a*, and is substantially continuous throughout at least part of ejection section 14*b*, such that there is no substantial neck or throttling between the chamber and a port 19 that is formed in a wall of the injection feed system 10 within the ejection region 14*b*. In some embodiments the piston may partially enter the ejection region 14*b*. The port 19 at a substantially vertically upward angle, opposite the bottom part of the piston chamber 14 where lubricant tends to pool. A channel 20 extends from the port 19 to mould 12 with a channel 20. The channel 20 is preferably slightly convergent or of substantially uniform cross-sectional area, although the path need not be cylindrical or rectangular. This channel 20 can be short, for example shorter than a diameter of the piston mating section 14*a*, which is difficult to obtain for prior art concentric right angle exit schemes known in the art.

The butt end trap 14*c* has a length that is chosen to collect a prescribed volume of the bottom surface skin that includes at least the contaminated skin where lubricant mixed with the skin, and preferably substantially the entire skin. In general an important trade-off in relation to the thickness of the butt end trap 14*c* is the amount of wasted material, and the effectiveness of the inclusion trapping. The shape of an end wall of the piston chamber 14 may have a variety of configurations to encourage inclusion trapping and decrease wasted material 11, but is shown as a planar wall in FIGS. 2*a,b*. For example, end wall configurations that encourage radially inward flow beyond the ejection section 14*b* may be preferred for retaining inclusions on an inner periphery of the chamber, or configurations that encourage flow beyond the ejection section 14*b* downwards, may be provided. The flow may be encouraged by cooperating features on the piston and end wall. Furthermore while the butt end trap 14*c* is shown as a closed end, it will be appreciated that an opening at the butt end, especially near the bottom that removes accumulated lubricant, possibly along with various amounts of the skin can also be provided, and may be disposed at an angle with respect to flow through the short channel 20 so as to maximize the communication of pressure from the piston chamber 14 through the short channel 20, to the mould 12.

Figure 2B:
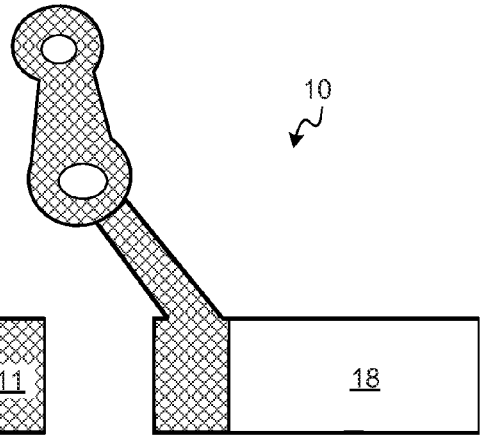

While the embodiment of FIG. 2 is expected to provide improvements over the prior art in terms of laminarity of flow, and simplicity of demoulding, and to provide some advantage in terms of reducing inclusions by virtue of the butt end trap, in some applications it may be preferred to further improve laminarity of the flow by shaping the channel 20, and/or to include a secondary trap. These features are provided in the embodiment of FIG. 3.

Figure 3A:
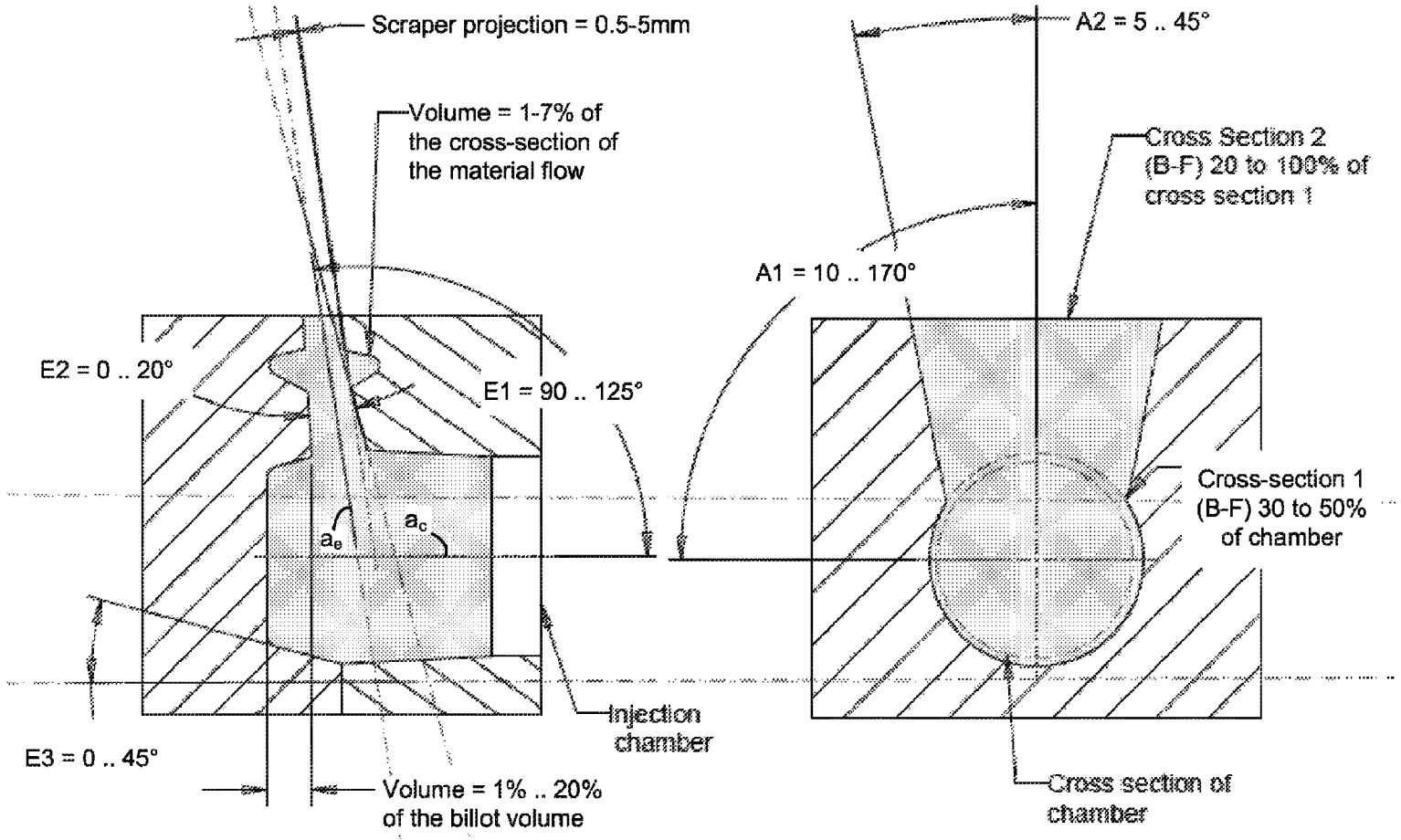
FIGS. 3*a,b* are schematic illustrations of a particular design of a semi-solid metal alloy injection feed system in accordance with an embodiment of the invention, showing a number of parameters that can be varied, and identifies the specific parameters of the design chosen for study, respectively.

FIG. 3*a* shows ranges of parameters found to be useful in accordance with an embodiment of the invention. On the right is a cross-section view of the assembled feed system, and on the right is an end-on view of one part of the two-piece feed system, or, in other words, the cross-section of the assembled feed system taken along the parting line. It is noted that the over-all configuration provides a more direct feeding system than the prior art in that the piston chamber and mould entrance are not separated by a throttling section for accelerated material flow through a sharp bend, and into the mould, and further that the distance from the piston chamber to the mould can be very short (less than a diameter of the piston mating section and less than 100 mm: it is about 56.6 mm in the illustrated embodiment, and if the secondary tank were removed, it could be significantly shorter). The dimensions of injection feed systems generally scale with the volume of the part or parts to be formed in a single shot, as is known in the art. The cross-sectional area of cross-section 1 (i.e. where the channel meets the piston chamber) is at least 15% of the cross-sectional area of the piston chamber. In general this cross-section may be from 20% to 50% and more preferably 30%-40% of the piston cross-section. While it is not generally recommended to go outside this range of cross-section area ratios, it is noted that it should be possible to produce operable feed systems having cross-section area ratios of 15-20% or 50-60%, as may be desired for particular small or complex parts. An exit port of the channel (cross-section 2) has a cross-section no greater than that of cross-section 1, on pain of slowing the flow during the ejection. Preferably cross-section 2 is 20 to 100% the area of cross-section 1. In the illustrated embodiment there is a narrowing of 28% during transit through the channel.

It will also be noted that the exit from the piston chamber is not concentric with the piston, but is radially offset and, in the illustrated embodiments, oriented at an angle to the piston axis. The side view shows that an axis of the exit flow $a_e$ meets a center axis of the piston $a_c$ at an angle E1. In general the higher E1 above about 125°, the more difficult it is to provide demoulding, the less efficient the butt end trap, and the more complicated the parting line of the feed system. The lower E1 (90° or lower), the more difficult it is to provide a high laminarity flow at a desirable injection rate. Accordingly it is indicated in FIG. 3*a* that E1 ranges from 90-125°, as this is the recommended range. More preferably the angle E1 ranges from 92-119°. The illustrative embodiment produced and tested has an angle E1 of 99°. It is considered possible to design an operable feed system with E1 ranging from 125-135°. These two axes ($a_e$,$a_c$) define a plane of the flow during ejection. E2, the angle of convergence of the channel in the side view, is preferably from 0-20°, more preferably 5-15°. In the illustrative embodiment E2 is 11°.

From about the middle of the ejection region to the butt end trap, the cross-section of the chamber narrows radially uniformly, except at the port in the top section of the chamber. Throughout this region, the chamber wall is substantially conic, having an angle E3, which may vary from 0-45°, more preferably from 10-25°. In the illustrative embodiment E3 is 15°. This reduces a volume of the butt end trap and wasted material.

The butt end trap preferably has an axial ($a_c$) depth of at least 5% the diameter of the chamber, or 5% a mean diameter of the chamber if the chamber is not cylindrical. There is no upper bound on depth of the chamber, but that imposed by a desire to minimize wastage and a limit on the size of the billet. Applicant has found that a depth of 20-25% the diameter of the chamber is adequate.

A secondary tank in the channel is located in a channel connecting the chamber to the mould. The volume of the secondary tank may be 1-15% preferably 1-10% or 1-7% of the volume of injected material. The secondary tank has an oxide stripper that is geared to remove a thin section e.g. 0.5-5 mm, of the channel flow on two opposite sides. In other embodiments the scraper operate on only one side or may scrape all around the flow, and may be positioned at different places within the channel.

The front view shows clearly how the angle A1 of the plane of the flow with respect to vertical is preferably 0°, but may vary from 10° to 170°. The angle A2 of divergence of the channel in the front view is shown as 11°, but may vary from 5-45°, more preferably from 8-20°, as long as the cross-sectional area of the channel does not narrow towards the egress and the cross-sectional area requirements are met.

While the foregoing examples had a single port and channel, it will be appreciated that multiple ports directly from the chamber and/or branching channels leading to multiple moulds are possible.

Example 1

Simulations

Figure 3B:
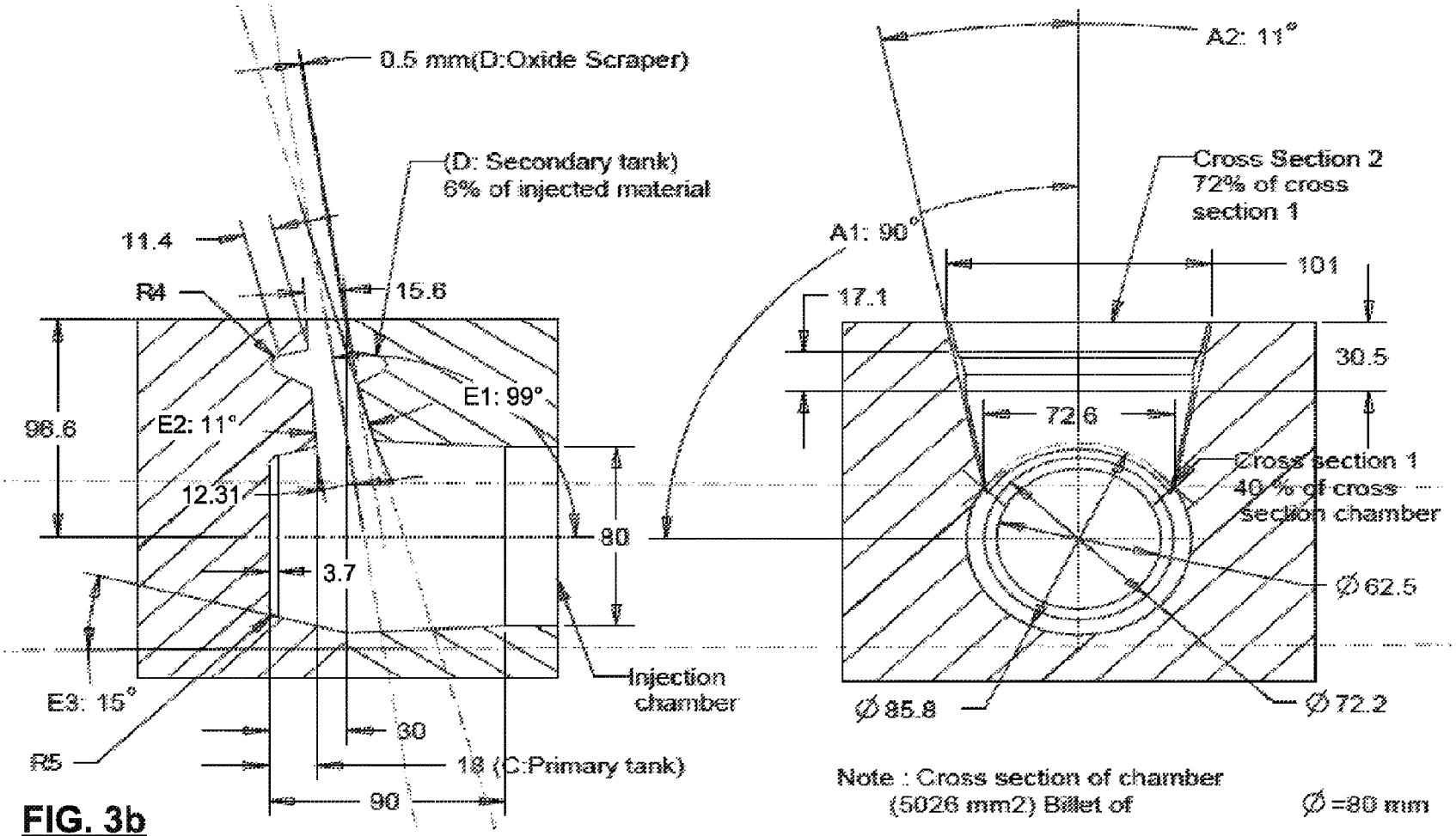

A series of simulations were performed to examine design options for semi-solid injection. The objective of the simulations was to produce a design that retains the greatest flow laminarity, while trapping the greatest majority of inclusions. To this end, numerous simulations were performed with different flow parameters typical of semi-solid injection. The specific dimensions of the injection feed system chosen for analysis are shown in FIG. 3*b*. The principle simulation parameters were:

| | |
|---|---|
| Mould temperature | 300° C. |
| Material (chamber) temperature | 585° C. |
| Injection Speed (Piston) | 0.3 m/s |
| Billet dimensions | 80 mm diameter by 180 mm long |
| Mass of billet | 2.1-2.3 kg |
| Material composition | AL 357 |

The relevant rheological properties of AL 357 are well known in the art. The software Procast 2006 from ESI GROUP was use for all simulations. Specifically, these simulations were done by using isotherm flow solver module of the Procast software.

As a result of these simulations, a model having improved trapping while retaining better flow laminarity was identified. Specifically, by placing the exit from the chamber in a non-concentric manner, but at or near the periphery of the chamber, it is possible to retain flow laminarity to an acceptable degree. As will be appreciated by those of skill in the art, it is generally desirable to inject as quickly as possible to reduce heat loss throughout the injection, to reduce flow resistance.

Figure 4B:
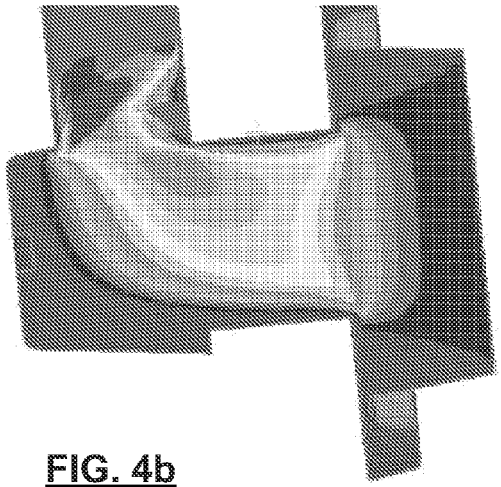
FIG. 4*b* shows a simulated velocity map showing high turbulence injection of a semi-solid metal alloy using the prior art design of FIG. 1.
Figure 4A:
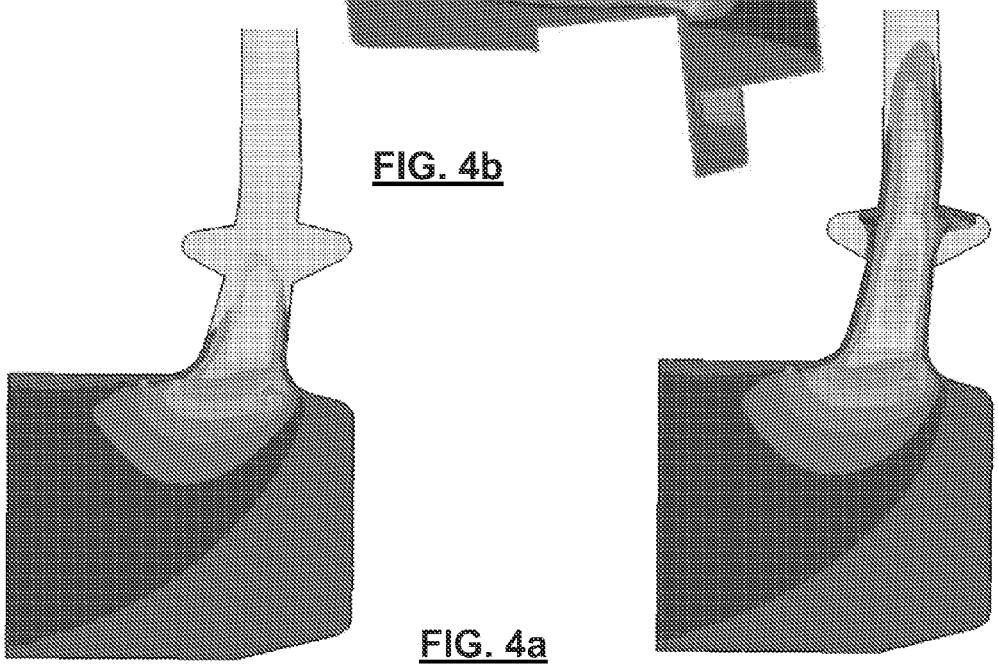
FIG. 4*a* shows simulated velocity maps at two time points in a simulated ejection, the velocity maps exhibiting low-turbulence flow using the design of FIG. 3*b;*

FIG. 4*a* schematically illustrates velocity maps showing instantaneous flow of the modelled semi-solid metal alloy. The colour map relating velocity to greyscale is ambiguous in the given representation, and has been removed. The velocity maps are cross-sectional 2-dimensional representations of the modelled flow along the flow plane before and after the skimming of the material by the secondary tank. More specifically, the earlier velocity map corresponds to a time interval of 0.6811 milliseconds at 0.3206 seconds from the start of the simulation, and the later represents a same time interval at 0.3805 s from the start. In both cases the flow lines are smooth, well spaced, and show little change over time. The later velocity map shows how the material is skimmed while passing through the secondary tank.

Comparisons were made between simulations of the prior art feed system (FIG. 1) and the feed system of FIG. 3*b*. FIG. 4*b* shows a cross-sectional velocity map of the simulated flow through the neck and around a sharp corner of the prior art feed system taken at a moment when the leading edge of the flow has just rounded the corner of the feed system. The flow has jagged edges at the throttling neck region and in the neighbourhood of the corner. Furthermore highly non-uniform flow near the leading edge is obvious. A marked improvement in the flow laminarity with the feeding system of FIG. 3 at a same piston injection speed as in FIG. 1 is noted.

The ranges of parameters identified with respect to FIG. 3*b* were verified by changing each parameter with respect to the remainder, using the simulations. The most crucial parameters are E1, C, the ratio of S2/S1 and the length of the channel. A2 co-varies with the ratio between the cross-sectional area 1 and 2. The non-concentric positioning of the channel has a large effect on the system. The parameters E1, E2 and E3 have an effect directly on the flow front and the cross-section area S1 and S2, are of significant importance for the convergence. Convergence facilitates the control of the flow front by decreasing turbulences and inclusions (voids, gas trap, etc. . . . ) during the filling stage of the parts. The C and D parameters are the control for the inclusions in the part.

Example 2

Prototype Infection Feed System

Figure 5:
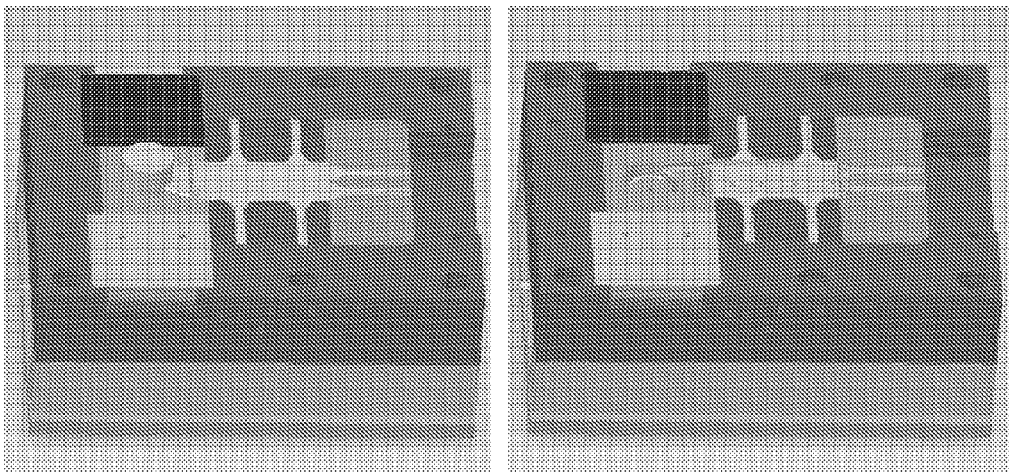
FIG. 5 is an image of a prototype injection feed system embodying the design of FIG. 3*b*.

A horizontal injection feed system was produced having the specifications shown in FIG. 3*a*. This injection feed system is shown in FIG. 5. The injection feed system was formed as a H13 steel insert for an existing cavity and piston set made by Buhler (530 ton). The insert was formed of 6 pieces: four retention blocks, and two mating pieces that form the upper and lower parts of the end of the chamber.

Characterization

Figure 6A:
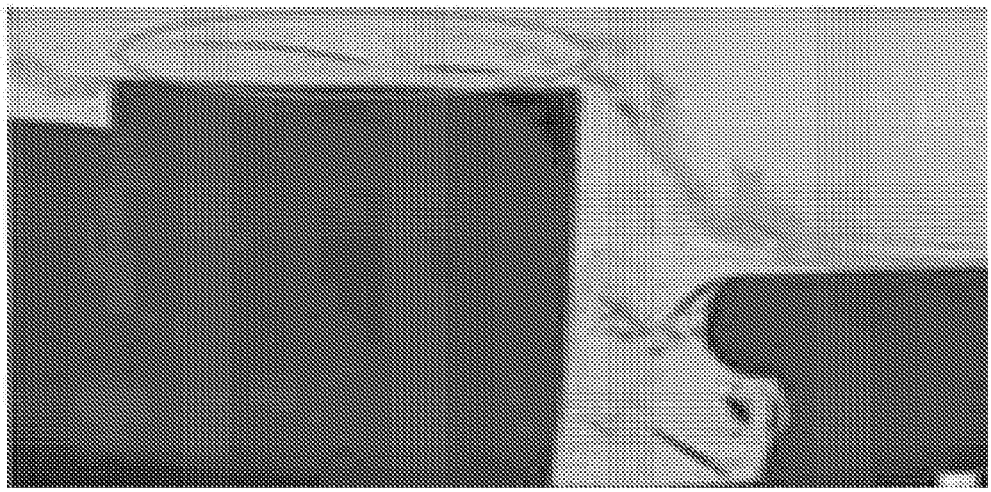
FIGS. 6*a,b,c* are images showing analyses of solidified remains from injection feed systems in accordance with the prior art and invention.
Figure 6B:
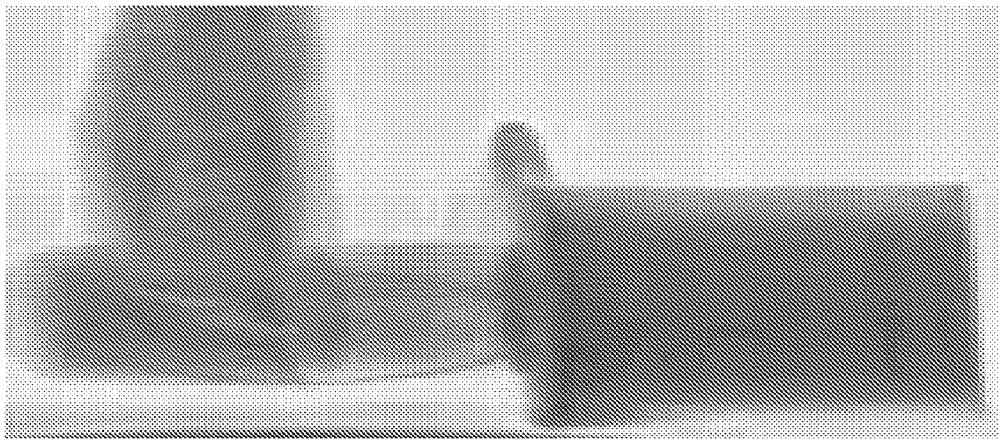

FIGS. 6*a,b* are images of solidified parts from the feed system of FIG. 1. Metallographic analysis performed on a section of one of them (FIG. 6*a*) using an optical microscope shows the flow of inclusions up a slope caused by a ramp of skin in the annular skimming trough, and the advance of these inclusions into the concentric neck of the chamber. FIG. 6*b* is an X-ray image showing the inclusions within the neck, as well as the head and around the right angle bend.

A study of this horizontal injection feed system produced 200 parts. Several dozen parts were analyzed. 40 samples were cut and polished for metallographic analysis, and an equal number were subjected to tensile tests. Visual inspection of the polished sections showed no inclusions of a dimension greater than 200 μm. The tensile tests demonstrated that all the parts had a minimum strength of 310 MPa (for A357-T6).

Figure 6C:
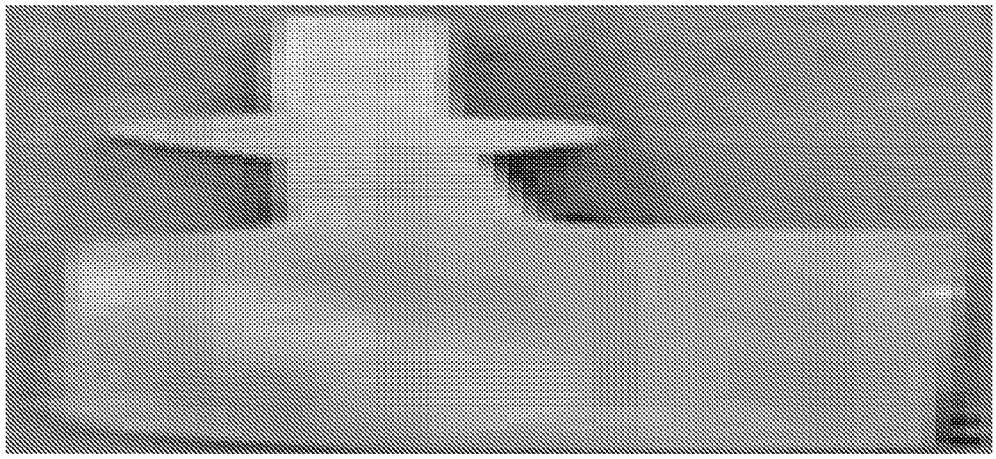

FIG. 6*c* is an X-ray image showing substantially no inclusions throughout the channel of the part from the feed system of the present invention.

The foregoing examples were performed under the rheocasting conditions, but are equally applicable to other semi-solid injection techniques (thixoforming, thixocasting, etc.)

While the example is designed and used for a horizontal injector, it is expected that the same design having non-concentric (with the piston) exit and, preferably a butt end trap, can be used in vertical semi-solid injectors. In a vertical arrangement, there is no preferred orientation for the angle A1.

References: The contents of the entirety of each of which are incorporated by this reference.

Other advantages that are inherent to the structure are obvious to one skilled in the art. The embodiments are described herein illustratively and are not meant to limit the scope of the invention as claimed. Variations of the foregoing embodiments will be evident to a, person of ordinary skill and are intended by the inventor to be encompassed by the following claims.

The invention claimed is:

1. A semi-solid metal alloy injection feed system comprising:

a substantially closed injection chamber for supporting flow of a billet of semi-solid metal alloy, the injection chamber having a piston mating section for receiving a piston in reciprocating motion; and a channel for communicating flow of the billet from an outlet of the injection chamber into a mould opening;

wherein the outlet is offset with respect to a center axis of the piston mating section, so that the center axis does not intersect the outlet, the outlet being the first substantial narrowing of the flow through the injection chamber, and the channel includes a trap having a scraper for stripping a surface from the flow through the channel.

2. The injection feed system of claim 1 wherein the channel has an axis that makes an angle of 90-135° with respect to the center axis, and the outlet has a cross-sectional area of 20-60% that of the piston mating section.

3. The injection feed system of claim 1 wherein the channel has an axis that makes an angle of 90-125° with respect to the center axis, and the outlet has a cross-sectional area of 30-50% that of the piston mating section.

4. The injection feed system of claim 1 wherein the outlet is offset from the center axis by at least 60% of the distance from the center axis to the periphery of the piston chamber.

5. The injection feed system of claim 1 wherein the channel is shorter than a diameter of the piston mating section.

6. The injection feed system of claim 1 designed for horizontal use, wherein:

the opening is positioned above an expected lubricant pooling region; or the opening is positioned substantially opposite an expected lubricant pooling region.

7. The injection feed system of claim 1 wherein the feed system is composed of two parts: one part including the piston mating section, part of the ejection section, and part of the channel, and the other part including the butt end trap, and the other part of the ejection section and channel, whereby separation of these two parts alone permit removal of a solidified part of the billet remaining in the injection feed system after use.

8. The injection feed system of claim 1 wherein the channel has an axis that makes an angle of 92-119° with respect to the center axis, and this is the only redirection of the flow within the injection feed system.

9. The injection feed system of claim 1 wherein the cross-section of the mould opening is 20-100% that of the outlet.

10. The injection feed system of claim 1 wherein the channel is shorter than 100 mm.

11. The injection feed system of claim 1 wherein the outlet is offset from the center axis by at least 85% of the distance from the center axis to the periphery of the piston chamber.

12. The injection feed system of claim 1 wherein the channel has a cross-section that gradually narrows from the outlet to the mould opening.

13. The injection feed system of claim 1 wherein channel has a cross-section that gradually narrows from the outlet to the mould opening by an angle of 0° to 20° in a plane of injection.

14. The injection feed system of claim 1 wherein the channel has a cross-section that gradually narrows from the outlet to the mould opening except in the vicinity of the scraper.

15. The injection feed system of claim 1 wherein the scraper removes a thin surface of the flow amounting to 1-15% by volume of the flow.

16. The injection feed system of claim 1 wherein the scraper removes 0.5-5 mm of the surface of the flow on one or more sides of the flow.

17. The injection feed system of claim 1 wherein the injection chamber includes a wall that extends continuously from the piston receiving section and into an ejection section, and the outlet is on the wall within the ejection section.

18. The injection feed system of claim 17 wherein a space between the ejection section and an end of the injection chamber provides a butt end trap;

a space between the ejection section and an end of the injection chamber provides a butt end trap wherein the injection chamber narrows from the ejection section to the end; or a space between the ejection section and an end of the injection chamber provides a butt end trap 5-30 mm deep.

* * * * *